US008960060B1

(12) United States Patent
Zaremski

(10) Patent No.: US 8,960,060 B1
(45) Date of Patent: Feb. 24, 2015

(54) SHARPENING ELEMENT FOR A CUTTING TABLE

(76) Inventor: Mark A. Zaremski, Downers Grove, IL (US)

( * ) Notice: Subject to any disclaimer, the term of this patent is extended or adjusted under 35 U.S.C. 154(b) by 888 days.

(21) Appl. No.: 12/880,387

(22) Filed: Sep. 13, 2010

(51) Int. Cl.
*B26D 7/12* (2006.01)

(52) U.S. Cl.
USPC ..... 83/174.1; 451/321

(58) Field of Classification Search
USPC ..... 83/174.1, 607, 174; 451/45, 321
IPC ..... B26D 7/12
See application file for complete search history.

(56) References Cited

U.S. PATENT DOCUMENTS

| | | | | | |
|---|---|---|---|---|---|
| 32,096 | A * | 4/1861 | Wattles | 241/271 |
| 92,548 | A * | 7/1869 | Sims | 83/174.1 |
| 679,168 | A * | 7/1901 | Hoyt | 241/101.2 |
| 925,512 | A * | 6/1909 | Rosewarne | 241/101.2 |
| 1,153,485 | A * | 9/1915 | Dansby | 83/174 |
| 1,945,582 | A * | 2/1934 | White | 56/250 |
| 2,477,295 | A * | 7/1949 | Garwood | 83/584 |
| 3,089,373 | A * | 5/1963 | Fischer et al. | 83/468 |
| 3,283,449 | A | 11/1966 | Pinkowski | |
| 3,540,166 | A | 11/1970 | Crumley | |
| 3,745,721 | A | 7/1973 | Williams | |
| 3,866,362 | A | 2/1975 | Riach | |
| 5,787,781 | A * | 8/1998 | Hile | 83/467.1 |
| 6,475,074 | B2 | 11/2002 | Blanton | |
| 6,595,093 | B1 * | 7/2003 | Artigas | 83/468.3 |
| 6,846,229 | B1 * | 1/2005 | Ranieri | 451/312 |
| 8,708,777 | B2 * | 4/2014 | Bagley et al. | 451/45 |
| 2004/0237745 | A1 * | 12/2004 | Dellinger et al. | 83/607 |
| 2007/0238402 | A1 | 10/2007 | Hensley | |

* cited by examiner

*Primary Examiner* — Keneth E. Peterson
(74) *Attorney, Agent, or Firm* — Pauley Petersen & Erickson

(57) ABSTRACT

A cutting table has a planar table surface with a linear cutting edge that is engaged by a moveable cutting blade that progressively contacts the cutting edge to make a cut. An elongate sharpening element extends along the cutting edge wherein the sharpening element will be progressively contacted by the blade with each cut, thereby sharpening the blade.

2 Claims, 2 Drawing Sheets

SHARPENING ELEMENT FOR A CUTTING TABLE

The present invention relates to cutting tables of the type used in conjunction with either a guillotine cutter or a rotary cutter, and in particular to a sharpener element incorporated into the table to sharpen the cutting blade.

BACKGROUND OF THE INVENTION

Cutting tables are used in conjunction with a cutting blade for making linear cuts in planar objects such as paper, fabric, roofing shingles, floor coverings, and the like. Typically, a cutting table has a planar upper surface and at least one elongate linear cutting edge against which a cutting blade is progressively moveable for advancing a cut across an object on the table.

The cutting edge for the table may extend along one side of the table body. Such tables are typically employed in a bypass cutter which has a curved guillotine blade having an inner end that is pivotally attached to the table and a handle at the outer end. By grasping the handle, the user can move the curved blade causing it to cut progressively along the length of the cutting edge, such that any object positioned on the table and extending across the edge will be cut by the blade.

A cutting table may also have a cutting edge that extends across a central portion of the upper surface of the table. Tables having centrally located cutting edges are generally referred to as slitters and employ rotary cutters. The typical rotary cutter is mounted on a slide bar that extends across the table parallel to the cutting edge. The rotary cutter is rotatably mounted on a holder and the holder is slideable along the slide bar. The blade is positioned to contact the cutting edge as the holder is progressively advanced along the slide bar.

Such cutting tables are employed in schools and businesses for cutting large quantities of material. In schools, the material is typically paper, but in the industrial sector many other materials are cut using cutting tables. The manufacturers of clothing and other objects made of fabric, for example, have cutting tables that are in constant use.

The usage of a cutting blade in conjunction with a cutting table gradually dulls the cutting blade. Where the blade and cutting table are in constant use, the gradual dulling of the blade results in a corresponding reduction in the efficiency of the cutting process. As a result, it is necessary to frequently sharpen or replace the cutting blade used in conjunction with the cutting table. Typically, the blade is only sharpened or replaced after it has become noticeably dull, and therefore the efficiency of the blade and table combination undergoes a repeating cycle wherein they operate efficiently together while the blade is sharp, but deteriorate over time as the dulling blade again causes inefficiencies. As a result of this repeating cycle, the quality of the output from a given blade and table combination is cyclical with some of the output being of poor quality. Also the blade and table combination must periodically be taken out of service while the blade is being sharpened or replaced.

It would be desirable to provide, therefore, a improved combination cutting blade and table that would include a sharpening element that would continuously sharpen the blade as it is used in conjunction with the table. Such a combination would result in a higher quality output and reduce or eliminate the need to periodically remove the combination of blade and table from service for sharpening.

SUMMARY OF THE INVENTION

Briefly, the present invention is embodied in a cutting table of the type having a table body with a planar table surface. The table also has a linear cutting edge that extends along the table surface. A moveable cutting blade is employed with the table with the cutting blade progressively advancing along the cutting edge to make the cut.

In accordance with the invention, an elongate sharpening element extends along the cutting edge such that the cutting blade also progressively contacts the sharpening element for sharpening the blade as it is advanced across the table to make each cut.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
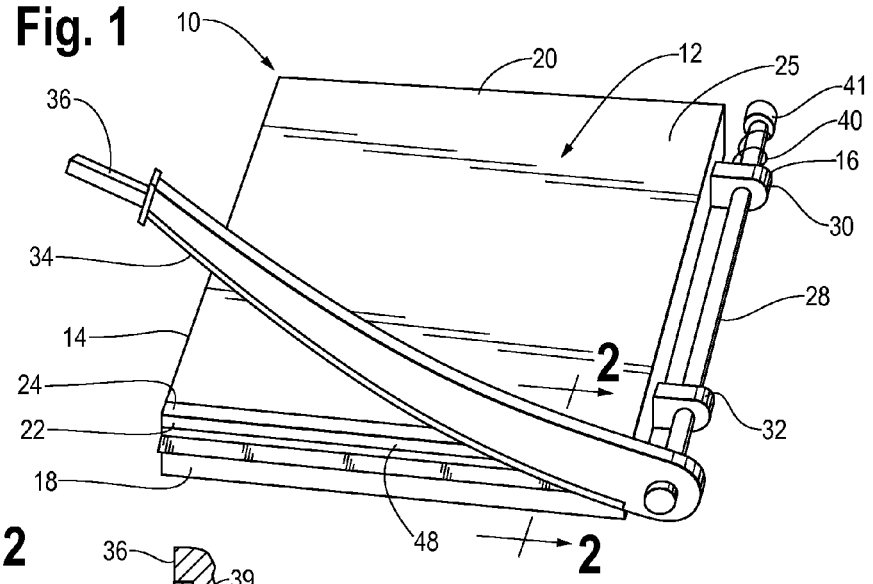
FIG. 1 is an isometric view of a guillotine cutter having a cutting table in accordance with the present invention.
Figure 2:
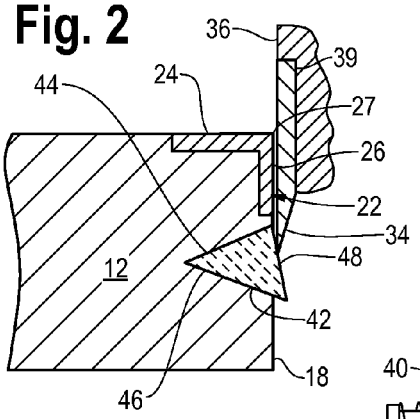
FIG. 2 is a fragmentary enlarged cross-sectional view of the cutting table shown in FIG. 1 showing a cutting element in accordance with the invention positioned with respect to the cutting edge of the table.
Figure 3:
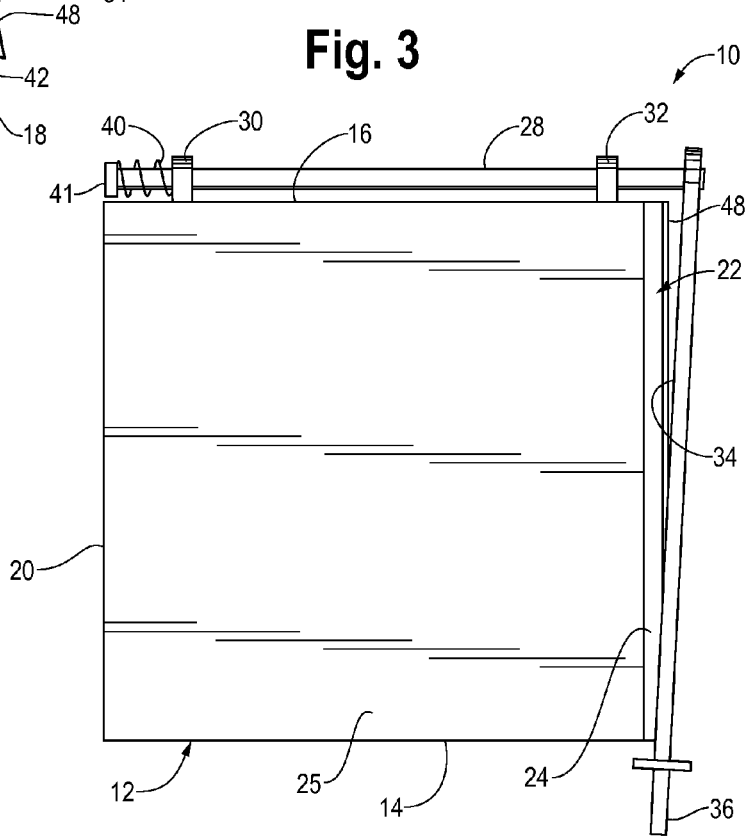
FIG. 3 is a top view of the cutting table shown in FIG. 1.

Referring to FIGS. 1, 2 and 3, a guillotine cutter 10 has generally rectangular cutting table 12. The cutting table 12 has a body with linear parallel sides 14, 16 and linear parallel ends 18, 20 oriented perpendicular to the sides 14, 16. One of the ends 18 has a metal insert 22 having an upper surface 24 parallel to the upper surface 25 of the table 12 and a vertical surface 26 that forms a sharp corner 27 with the upper surface 24 thereof. The elongate corner 27 formed by the intersection of the surfaces 24 and 26 forms a cutting edge of the table 12.

Positioned along one of the sides 16 of the table 12 is a cylindrical mounting bar 28 that is rotatably retained in parallel relationship to the side 16 by first and second mounting brackets 30, 32. Fixedly mounted, by a weld or other suitable means, at the outer end of the bar 28 is an arcuately shaped cutting blade 34. The cutting blade 34 has a handle 36 at the outer end thereof. The mounting bar 28 retain the blades 34 in an orientation that is generally transverse to the table 12 and nearly parallel to the cutting edge 24.

Figure 5:
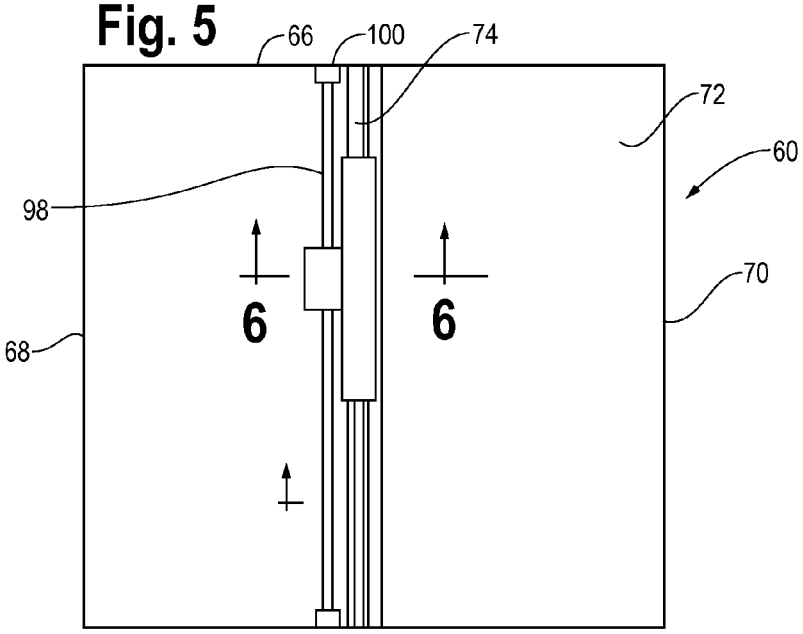
FIG. 5 is a top view of the cutting table shown in FIG. 4.

As best shown in FIG. 5, the blade 34 is not exactly perpendicular to the mounting bar 28 but is attached at a small angle such that the outer end of the blade 34 is slightly angled toward the far end 20 of the table 12. The blade 34 is urged toward the far end 20 of the table 12 by a coil spring 40 positioned around the circumference of the cylindrical bar 28 between the distal end 41 of the cylindrical bar 28 and one of the mounting brackets 30. The spring 40 urges the mounting bar 28 toward side 20. The coil spring 40 therefore urges the outer end of the blade 34 against the cutting edge 27. Accordingly, when an operator grasps the handle 36 and moves the blade 34 downwardly, the spring 40 continuously urges it against the cutting edge 27. Also, the arcuate structure of the blade 34 causes the contact point between the blade 34 and the cutting edge 27 to move progressively away from side 16 and toward side 14 to thereby make a cut.

In accordance with the present invention, positioned a short distance below the upper surface 25 is an elongate abrasive sharpening element 42. In the preferred embodiment, the sharpening element 42 is made of tungsten carbide and includes fine particles of hardened material such as a diamond power or the like embedded therein. The sharpening element 42 may have any cross-sectional shape. In the embodiment depicted, the cross-sectional shape is that of a triangle having sides 44, 46, 48, all of which are approximate equal in length. The sharpening element is embedded into the body of the cutting table 12 with one surface 48 have abrasive qualities and positioned to contact the blade 34 at a gradual angle 35. As the operator moves the handle 36 downwardly, the curve of the blade 34 causes the contact point between the blade 34 and sharpening element 42 to move progressively away from side 16 and toward side 14, thereby sharpening the cutting blade 34.

Figure 4:
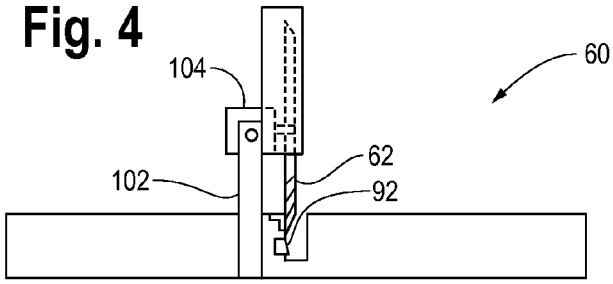
FIG. 4 is a side view of a rotary cutter positioned with respect to a cutting table in accordance with another embodiment of the invention.
Figure 6:
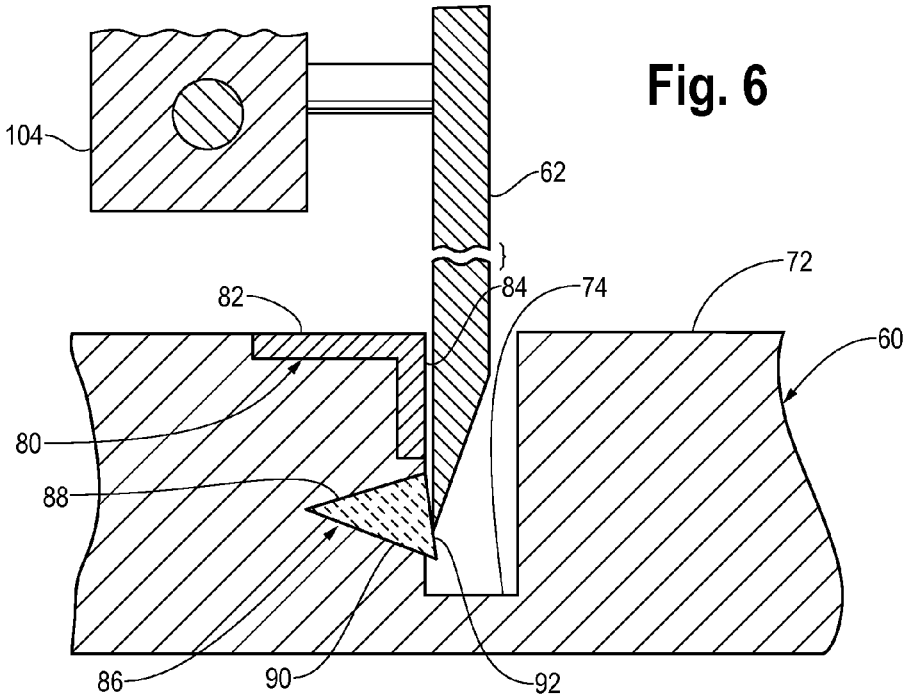
FIG. 6 is a fragmentary enlarged cross-sectional view of the cutting table shown in FIG. 4, showing the cutting edge and cutting element therein in accordance with the present invention.

Referring to FIGS. 4, 5 and 6, the invention can also be incorporated into a cutting table 60 for use with a rotary blade 62. In this embodiment, the table 60 is generally rectangular in shape and has parallel sides 64, 66 and parallel ends 68, 70 that are perpendicular to the parallel sides 64, 66. The upper surface 72 of the table is planar, however a transverse groove 74 extends through the surface 72 parallel to the outer ends 68, 70 and perpendicular to the sides 64, 66. The groove 74 has linear parallel edges, unnumbered. A metal insert 80 extends across the table 60 with a surface 82 of the insert 80 being co-planar with the surface 72 of the table and has a second machined surface 84 perpendicular to the surface 82 such that the intersection of the surfaces 82 and 84 form an edge of the groove 74 along which the blade 62 is moveable to make a cut.

Positioned below the surface 72 of the table 60, and below the metal insert 80 is an elongate sharpening element 86 in accordance with the invention. The sharpening element 86 may have any cross-sectional configuration; however, in the embodiment depicted, the sharpening element has a triangular cross-section having sides 88, 90, 92, all three of which are nearly equal in width. The sharpening element 86 is made of a hardened material such a tungsten carbide, and may have hard particles embedded therein such as particles of a diamond powder. The diamond powder provides an abrasive quality to one of the surfaces 92 of the sharpening element. The surface 92 is also oriented at a gradual angle with respect to the second surface 84 of the insert 80 and is positioned so as to contact the edge of the rotatable blade 62.

The cutting table 60 further has an elongate rigid slide bar 98 that extends across the surface of the table 60 with the ends thereof retained with respect to the table on parallel mounting bars 100, 102, with one mounting bar 100 positioned midway along side 64 of the table 60, and the other mounting bar 102 mounted midway along side 66 thereof. The slide bar 98 is thereby rigidly retained with respect to the table 60. Slideable along the slide bar 98 is a retainer 104 having a hub 106 thereon for rotatably receiving the disc-shaped rotary blade 62. An arcuate shield 110 extends around the upper portions of the rotary blade 62 to prevent the blade 62 from cutting the hands of a user.

The retainer 104 retains the hub 106 and rotary blade 62 with respect to the slide bar 108 such that the blade 62 will cut along the cutting edge 78 of the cutting table.

As best shown in FIG. 4, the parts are configured such that the cutting edge of the rotary blade 62 will extend deep enough into the groove 104 to contact the sharpening surface 92 of the sharpening element 86, thereby sharpening the blade as the cutter is used to cut an object positioned on the table 60.

While the present invention has been described with respect to two embodiments, it will be appreciated that many modifications and variations may be made without departing from the spirit and scope of the invention. It is therefore the intent of the following claims to cover all such modifications and variations that fall within the spirit and scope of the invention.

What is claimed:

1. A cutting table comprising:

a table body having a planar table surface, said table body having a linear cutting edge comprising a metal insert having an upper surface parallel to the planar table surface and a vertical surface that forms a sharp corner with the upper surface, a cutting blade moveably attached to said table wherein said cutting blade progressively contacts said cutting edge for making a cut, a coil spring urging the cutting blade towards the linear cutting edge, and an elongated sharpening element comprising tungsten carbide embedded into the table body of said cutting table with a surface of the elongated sharpening element extending at a gradual angle away from the vertical surface of the linear cutting edge, said sharpening element positioned below and extending along said cutting edge wherein the coil spring also urges said cutting blade to progressively contact said sharpening element at a gradual angle for sharpening said cutting blade with each cut.

2. The cutting table of claim 1 wherein said cutting blade is an elongated arcuate cutting member with a handle at one end and a second end pivotally mounted to said table wherein said arcuate cutting member progressively cuts along said cutting edge as said handle is moved.

* * * * *